US010743655B2

(12) United States Patent
Xiang et al.

(10) Patent No.: US 10,743,655 B2
(45) Date of Patent: Aug. 18, 2020

(54) LIFTING PLATFORM WITH A SLIDING KEYBOARD HOLDER

(71) Applicant: Loctek Ergonomic Technology Corp., Ningbo (CN)

(72) Inventors: Lehong Xiang, Ningbo (CN); Tao Lin, Ningbo (CN); Fangyuan Li, Ningbo (CN)

( * ) Notice: Subject to any disclaimer, the term of this patent is extended or adjusted under 35 U.S.C. 154(b) by 34 days.

(21) Appl. No.: 15/989,187

(22) Filed: May 25, 2018

(65) Prior Publication Data

US 2019/0110590 A1 Apr. 18, 2019

(30) Foreign Application Priority Data

Oct. 13, 2017 (CN) ..... 2017 2 1316594 U

(51) Int. Cl.
*A47B 21/02* (2006.01)
*A47B 21/03* (2006.01)

(52) U.S. Cl.
CPC ..... *A47B 21/02* (2013.01); *A47B 21/0314* (2013.01); *A47B 2021/0364* (2013.01); *A47B 2200/0076* (2013.01)

(58) Field of Classification Search
CPC .... A47B 2088/4276; A47B 2088/4278; A47B 21/02; A47B 21/0314; A47B 2021/0364; A47B 2200/0076; A47B 2021/0321; A47B 2021/0335
USPC ..... 248/431, 432, 439, 421, 562, 588, 585, 248/188.8, 188.2, 125.1, 125.8, 124.2, 248/411, 412, 413, 161, 157; 108/145, 108/50.01, 50.02, 147, 20, 150, 147.19; 312/223.3, 196; 24/524
See application file for complete search history.

(56) References Cited

U.S. PATENT DOCUMENTS 2,628,854 A * 2/1953 Gardner ..... F16B 7/1454 403/376
3,778,125 A * 12/1973 Gutmann, Jr. ..... A47B 21/00 312/223.3
4,515,086 A * 5/1985 Kwiecinski ..... A47B 21/0314 108/104
4,932,622 A * 6/1990 Hayakawa ..... F16B 7/1454 248/188.5

(Continued)

FOREIGN PATENT DOCUMENTS

DE 202016006439 * 12/2016
EP 1219204 * 7/2002

OTHER PUBLICATIONS

CN 105901942; Chen et al; abstract and figure (Year: 2016).*

*Primary Examiner* — Janet M Wilkens
(74) *Attorney, Agent, or Firm* — W&K IP

(57) ABSTRACT

A lifting platform with a sliding keyboard holder is disclosured. The lifting platform has a table plate, a base and a supporting leg connected with the table plate and the base, and a keyboard holder connected to the table plate. And the keyboard holder is slidably connected to the table plate in the vertical direction and is locked by a locking device. The keyboard holder can slide in the vertical direction to the position below the working table surface where the lifting platform is placed. With the above structure, the keyboard holder can be locked at any height at any time to meet the ergonomic requirements of different users, and the operation is simple, convenient and flexible.

4 Claims, 8 Drawing Sheets

(56) References Cited

U.S. PATENT DOCUMENTS

| | | | | | |
|---|---|---|---|---|---|
| 5,154,449 | A * | 10/1992 | Suei-Long | A47L 9/244 | 248/413 |
| 5,351,897 | A * | 10/1994 | Martin | A47B 21/0314 | 248/118 |
| 5,566,915 | A * | 10/1996 | Hansare | F16M 11/00 | 248/188.8 |
| 5,582,375 | A * | 12/1996 | Martin | A47B 21/0314 | 248/118 |
| 6,273,382 | B1 * | 8/2001 | Pemberton | A47B 21/0314 | 248/118.1 |
| 7,641,600 | B2 * | 1/2010 | Bingham, Jr. | A63B 22/00 | 24/516 |
| 8,631,747 | B2 * | 1/2014 | Woo | A61B 8/00 | 108/147 |
| 8,947,215 | B2 * | 2/2015 | Mandel | G06Q 10/109 | 108/147 |
| 9,133,974 | B2 * | 9/2015 | Tholkes | F16M 11/046 | |
| 10,154,729 | B2 * | 12/2018 | Blackburn | A47B 21/02 | |
| 2007/0080564 | A1 * | 4/2007 | Chen | A47B 21/0314 | 297/162 |
| 2008/0203865 | A1 * | 8/2008 | Chouinard | A47B 21/02 | 312/223.3 |
| 2015/0289641 | A1 * | 10/2015 | Ergun | A47B 9/16 | 108/42 |

* cited by examiner

LIFTING PLATFORM WITH A SLIDING KEYBOARD HOLDER

CROSS-REFERENCE TO RELATED APPLICATIONS

This application claims priority to Chinese Patent Application No. 201721316594.2 with a filing date of Oct. 13, 2017. The content of the aforementioned applications, including any intervening amendments thereto, are incorporated herein by reference.

TECHNICAL FIELD

The present disclosure relates to the field of furniture, and particularly relates to a lifting platform with a sliding keyboard holder.

BACKGROUND OF THE PRESENT INVENTION

Recently, a lifting platform on the table surface has gradually gained popularity in daily life for various purposes such as study, office work, entertainment and the like. The device usually comprises a table plate, a base and a lifting device. The table plate is connected to the base through a lifting device, and the base is placed on the table surface. The lifting platform in the prior art is generally provided with a keyboard holder, and the keyboard holder is connected with a base of the lifting platform through a bracket. The connection mode of the keyboard holder is generally fixedly connection with screws. One of the defects of this structure is that the keyboard holder must be disassembled and assembled by means of a manual tool, thus more time-consuming and troublesome, and cannot meet the requirement for fast dismounting and assembling. Another sample of the lifting platform in the prior art includes a keyboard holder which is detachably inserted into the lifting platform, a fixed connecting plate arranged on the table plate, and a hanging plate arranged on the keyboard holder. The hanging plate is hung and connected to the fixed connecting plate. One of the defects of this electric lifting platform with hanging keyboard holder is that the height of the keyboard holder usually be adjusted at the position of a fixed point due to the hanging connection, and the keyboard holder cannot be locked at any height at any time, which leads to limited height selection range of the keyboard holder and a small group of users to coordinate; in addition, in order to meet the ergonomic requirements, the keyboard holder is arranged below the working table surface in a common computer desk, however the lowest position of the keyboard holder of the electric lifting platform in the prior art is located at the working table surface, and cannot be adjusted to the position below the working table surface, therefore, the keyboard holder of the electric lifting platform in the prior art does not meet the ergonomic requirements.

SUMMARY OF PRESENT INVENTION

An objective of the present disclosure is to provide a lifting platform with a sliding keyboard holder of which the keyboard support can be locked at any height at any time with simple and convenient operation, so that the ergonomics requirements of different users are met.

The present disclosure discloses a lifting platform with a sliding keyboard holder, comprising a table plate and a base, a supporting leg to connect table plate with base, a keyboard holder connected to the table plate, the base is placed on the working table surface, wherein the keyboard holder is slidably connected to the table plate in the vertical direction and is locked by a locking device, the moving route of the keyboard holder in the vertical direction is from the position below the working table surface to the position above the working table surface.

The keyboard holder is connected with the table plate through a sliding structure, and the sliding structure is of a sleeve structure, the table plate is connected to the upper end of the sleeve structure, and the keyboard holder is connected to the lower end of the sleeve structure.

The sleeve structure comprises an upper connecting plate, an inner sliding sleeve, an outer sliding sleeve, an outer cover shell and a lower connecting plate, the upper connecting plate is of L-shape, one side of the L-shape is fixedly connected with the table plate, the other side of the L-shape is fixedly connected with the inner sliding sleeve; the inner sliding sleeve is in sliding connection with the outer sliding sleeve, the outer sliding sleeve is fixedly connected with the outer cover shell; the lower connecting plate is horizontally arranged and connected to the lower end of the outer cover shell; the keyboard holder is fixedly connected to the lower connecting plate.

The outer cover shell and the lower connecting plate are connected together; a threaded hole is formed in the edge of the outer cover shell, the lower connecting plate is connected to the threaded hole of the outer cover shell from bottom to top through a screw, the lower connecting plate is provided with a buckling groove, and the bottom end of the outer sliding sleeve is provided with a buckle which is buckled with the buckling groove.

The locking device is installed on the outer cover shell; a through hole is formed in the side wall of the outer sliding sleeve corresponding to the locking device; a locking block penetrates the through hole and is tightly pressed on the side wall of the inner sliding sleeve when locking.

The locking device further comprises a handle, a handle support and a pressing cap; the handle support is fixedly connected to the side wall of the outer cover shell; the handle is hinged to the handle support, and a small through hole is formed in the bottom surface of the handle support; the pressing cap comprises a plate-shaped cap edge and a cap barrel with a bottom, the cap edge is located on the inner side of the side wall of the outer cover shell, and the cap barrel penetrates the side wall of the outer cover shell and the small through hole of the handle support and is tightly pressed with the handle; the shape of the locking block is a cap with a cap edge matched with the shape of the pressing cap; the cap barrel of the locking block is fastened in the cap barrel of the pressing cap; the cap edge of the locking block is clamped with the cap edge of the pressing cap; the end surface of the cap edge of the locking block is located outside the end surface of the cap edge of the pressing cap; when locking, the end surface of the locking block is abutted against the side wall of the inner sliding sleeve; the planes of rotation of the handle comprise a flat surface and an arc surface, the distance between the flat surface to the rotating center of the handle is further than the distance from the arc surface to the rotating center of the handle, the flat surface of the handle is propped against the cap barrel when locking; and the arc surface of the handle is in contact with the cap barrel when loosened.

Compared with the prior art, the structure above has the following advantages:

1) The keyboard holder is connected to the table plate in a sliding mode, a user only needs to loosen the locking device to adjust the keyboard holder to a proper height and then lock the locking device. The keyboard holder can be locked at any height at any time, so that the ergonomic requirements of different users are met and the operation is simple and flexible.

2) The structure of the sliding part making the sliding adjustment more smooth through the sliding fit of the inner sliding sleeve and the outer sliding sleeve. The outer sliding sleeve penetrates the outer cover shell to be directly buckled with the lower connecting plate, so that the connecting structure is simpler.

3) The locking device adopts a combination of the pressing of the arc surface and the flat surface on the handle, equivalent to the structure of a cam, either locked at a small radius, or locked at a large radius by the pulling of the handle, which is simple and convenient.

DESCRIPTION OF THE DRAWINGS

The present disclosure is illustrated by way of examples and is not limited by the accompanying drawings, in which similar reference numbers indicate similar elements, and in which.

REFERENCE NUMBERS 1 table plate; 2 supporting leg; 3 base; 4 keyboard holder; 5 upper connecting plate; 6 inner sliding sleeve; 7 outer sliding sleeve; 8 outer cover shell; 9 lower connecting plate; 10 handle; 11 handle support; 12 pressing cap; 13 locking block; 14 buckling groove; 15 buckle; 16 through hole; 17 small through hole; 18 threaded hole

DETAILED DESCRIPTION OF PREFERRED EMBODIMENTS

Various aspects of the illustrative embodiments of the present disclosure will be described herein using terms commonly employed by those skilled in the art. However, it will be apparent to those skilled in the art that alternate embodiments may be practiced with only some of the described aspects. For purposes of explanation, specific numbers, materials and configurations are set forth in order to provide a thorough understanding of the illustrative embodiments. It will be apparent that alternate embodiments may be practiced without the specific details. In other instances, well-known features are omitted or simplified in order not to obscure the illustrative embodiments.

Figure 1:
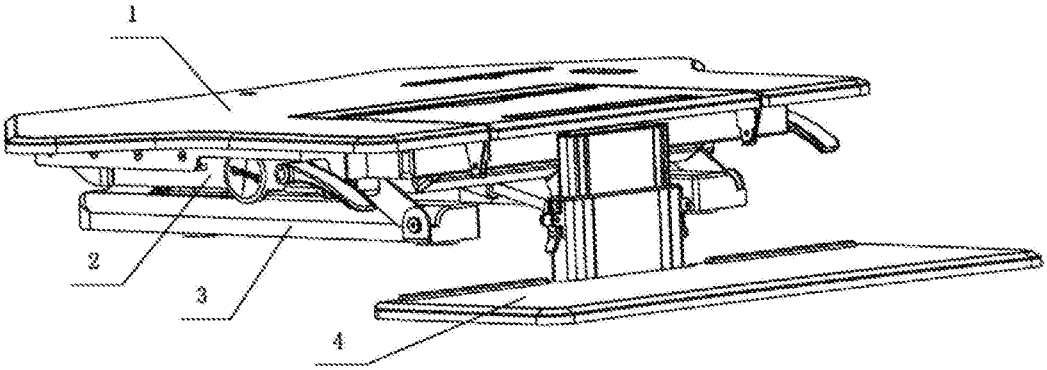
FIG. 1 illustrates a schematic structural diagram of the lifting platform with a sliding keyboard holder.
Figure 2:
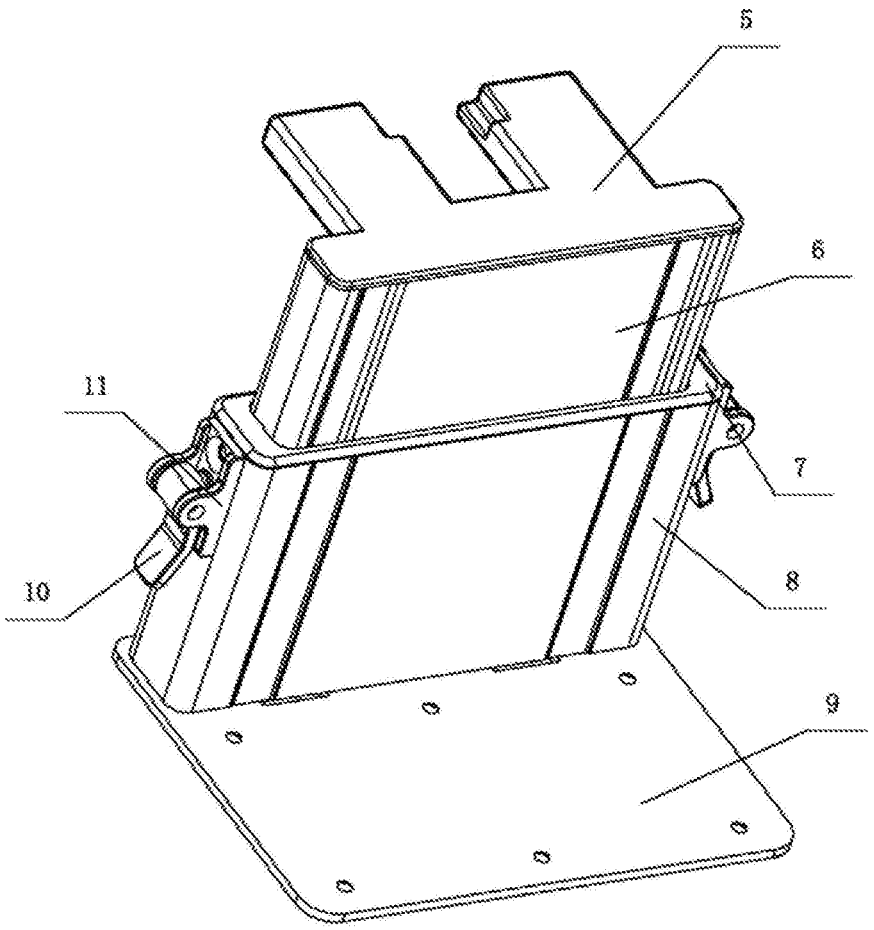
FIG. 2 illustrates a schematic structural diagram of the sliding part of the present disclosure.
Figure 3:
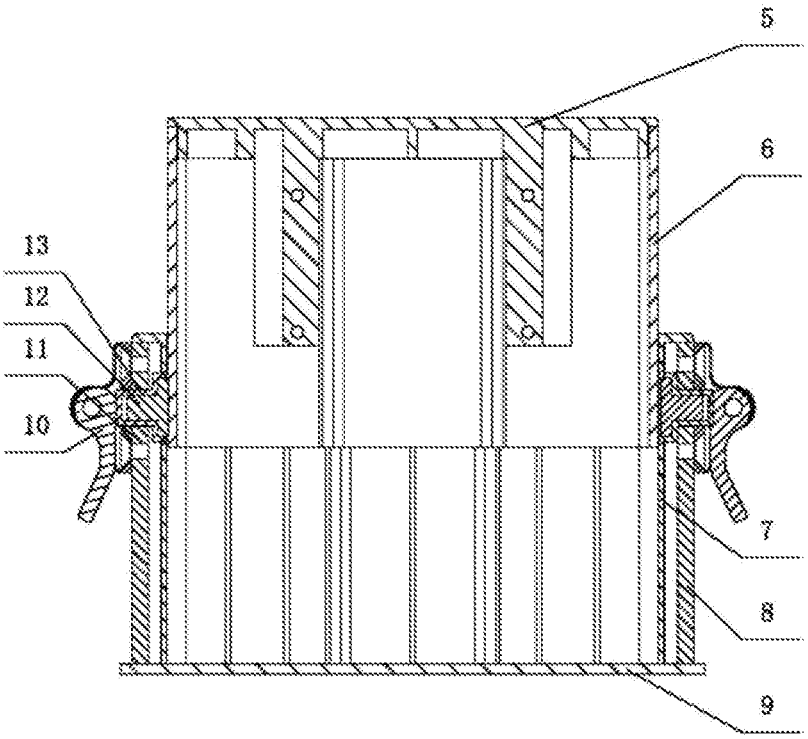
FIG. 3 illustrates a sectional view of the sliding part of the present disclosure.
Figure 4:
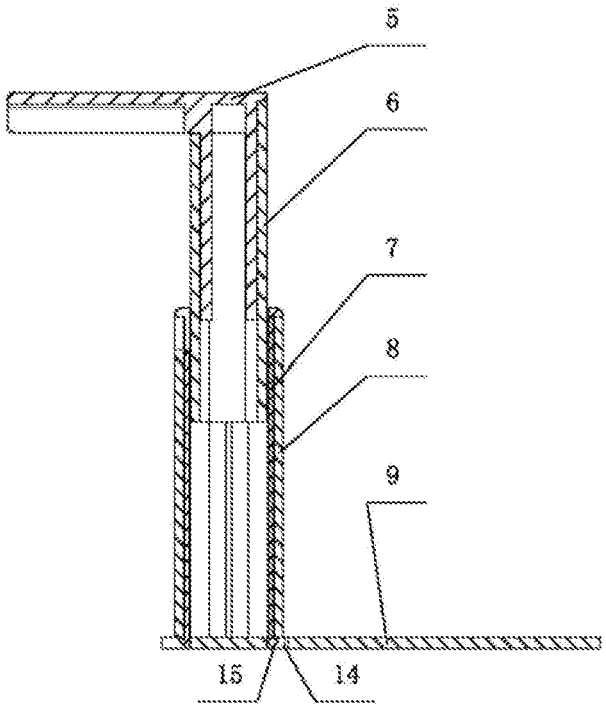
FIG. 4 illustrates another sectional view of the sliding part of the present disclosure.
Figure 5:
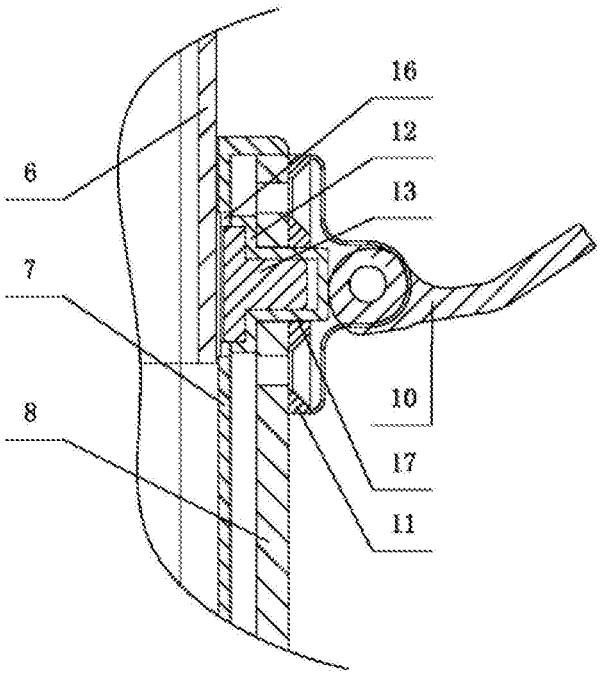
FIG. 5 illustrates a schematic structural diagram of the locking device of the present disclosure when unlocking.
Figure 6:
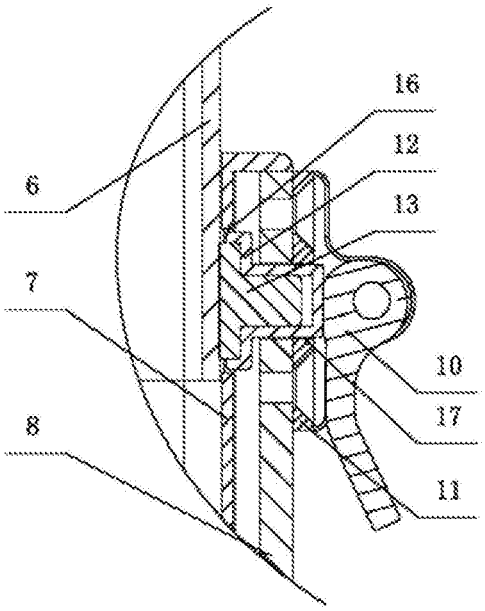
FIG. 6 illustrates a schematic structural diagram of the locking device of the present disclosure when locking.
Figure 7:
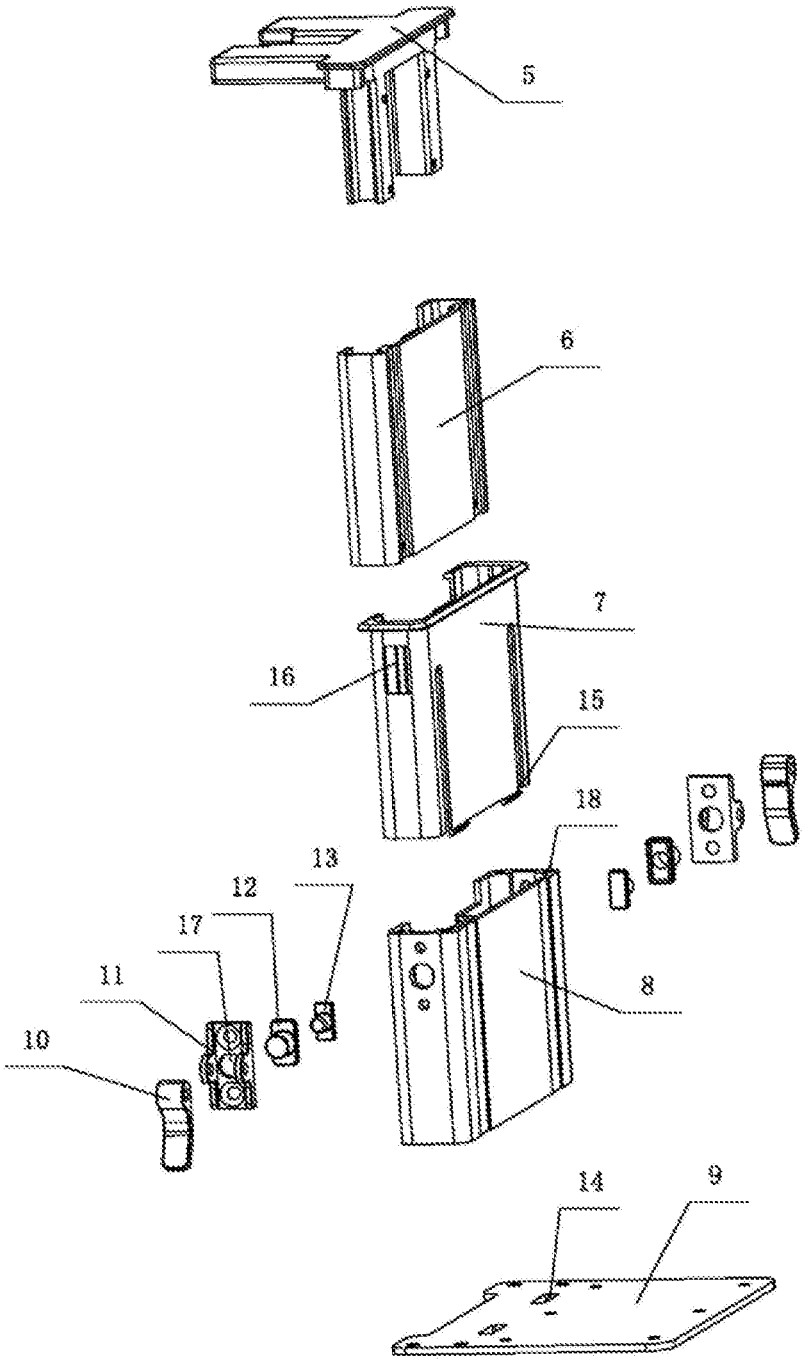
FIG. 7 illustrates schematic view of an explosion structure of the sliding part of the present disclosure.
Figure 8:
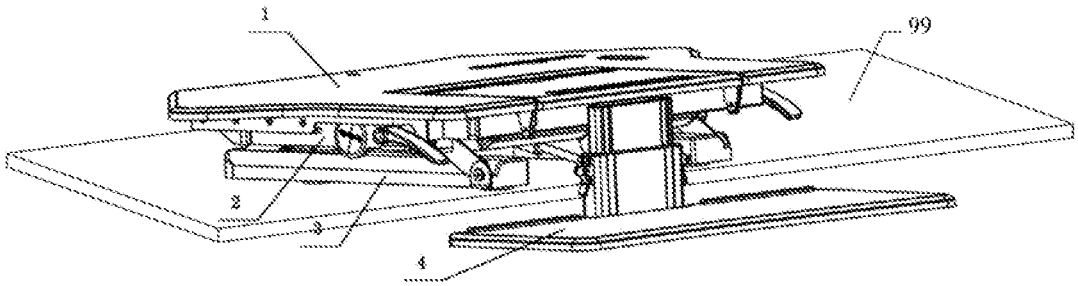
FIG. 8 illustrates a schematic structural diagram of the lifting platform with a sliding keyboard holder on a working table surface.

As shown in FIG. 1~FIG. 8, the structure of the lifting platform with the sliding keyboard holder comprises a table plate 1 and a base 3, a supporting leg 2 to connect table plate 1 with base 3, a keyboard holder 4 connected to the table plate 1, the base 3 is placed on the working table surface, wherein the keyboard holder 4 is slidably connected to the table plate 1 in the vertical direction and is locked by a locking device, the moving route of the keyboard holder 4 in the vertical direction is from the position below the working table surface (99) to the position above the working table surface.

The keyboard holder 4 is connected with the table plate 1 through a sliding structure, and the sliding structure is of a sleeve structure, the table plate 1 is connected to the upper end of the sleeve structure, and the keyboard holder 4 is connected to the lower end of the sleeve structure.

The sleeve structure comprises an upper connecting plate 5, an inner sliding sleeve 6, an outer sliding sleeve 7, an outer cover shell 8 and a lower connecting plate 9, the upper connecting plate 5 is of L-shape, one side of the L-shape is fixedly connected with the table plate 1, the other side of the L-shape is fixedly connected with the inner sliding sleeve 6; the inner sliding sleeve 6 is in sliding connection with the outer sliding sleeve 7, the outer sliding sleeve 7 is fixedly connected with the outer cover shell 8; the lower connecting plate 9 is horizontally arranged and connected to the lower end of the outer cover shell 8; the keyboard holder 4 is fixedly connected to the lower connecting plate 9.

The outer sliding sleeve 7, the outer cover shell 8 and the lower connecting plate 9 are connected together; a threaded hole 18 is formed in the edge of the outer cover shell 8, the lower connecting plate 9 is connected to the threaded hole 18 of the outer cover shell 8 from bottom to top through a screw, the lower connecting plate 9 is provided with a buckling groove 14, and the bottom end of the outer sliding sleeve 7 is provided with a buckle 15 which is buckled with the buckling groove 14.

The locking device is installed on the outer cover shell 8; a through hole 16 is formed in the side wall of the outer sliding sleeve 7 corresponding to the locking device; a locking block 13 penetrates the through hole 16 and is tightly pressed on the side wall of the inner sliding sleeve 6 when locking.

The locking device further comprises a handle 10, a handle support 11 and a pressing cap 12; the handle support 11 is fixedly connected to the side wall of the outer cover shell 8; the handle 10 is hinged to the handle support 11, and a small through hole 17 is formed in the bottom surface of the handle support 11; the pressing cap 12 comprises a plate-shaped cap edge and a cap barrel with a bottom, the cap edge is located on the inner side of the side wall of the outer cover shell 8, and the cap barrel penetrates the side wall of the outer cover shell 8 and the small through hole 17 of the handle support 11 and is tightly pressed with the handle 10; the shape of the locking block 13 is a cap with a cap edge matched with the shape of the pressing cap 12; the cap barrel of the locking block 13 is fastened in the cap barrel of the pressing cap 12; the cap edge of the locking block 13 is clamped with the cap edge of the pressing cap 12; the end surface of the cap edge of the locking block 13 is located outside the end surface of the cap edge of the pressing cap 12; when locking, the end surface of the locking block 13 is abutted against the side wall of the inner sliding sleeve 6; the planes of rotation of the handle 10 comprise a flat surface and an arc surface, the distance between the flat surface to the rotating center of the handle 10 is further than the distance from the arc surface to the rotating center of the handle 10, the flat surface of the handle 10 is propped against the cap barrel when locking; and the arc surface of the handle 10 is in contact with the cap barrel when loosened.

The description of the present innovation has been presented for purposes of illustration and description, but is not intended to be exhaustive or limited to the innovation in the form disclosed. The embodiment was chosen and described in order to best explain the principles of the innovation and the practical application, and to enable others of ordinary skill in the art to understand the innovation for various embodiments with various modifications as are suited to the particular use contemplated. Many modifications and variations will be apparent to those of ordinary skill in the art without departing from the scope and spirit of the innovation, for example:

1. The sleeve structure comprises an upper connecting plate, an inner sliding sleeve, an outer sliding sleeve, an outer cover shell and a lower connecting plate; the upper connecting plate is of L-shape, and one side of the L-shape is fixedly connected with the table plate while the other side of the L-shape is fixedly connected with the inner sliding sleeve, the outer sliding sleeve is in sliding connection with the inner sliding sleeve, the inner sliding sleeve is fixedly connected with the outer cover shell, the lower connecting plate is horizontally arranged and is connected to the lower end of the outer cover shell, the keyboard holder is fixedly connected to the lower connecting plate; at the moment, the inner sliding sleeve, the outer cover shell and the lower connecting plate are connected together, and a threaded hole is formed in the edge of the outer cover shell, the lower connecting plate is connected to the threaded hole of the outer cover shell from bottom to top through a screw, the lower connecting plate is provided with a buckling groove, and the bottom end of the inner sliding sleeve is provided with a buckle which is buckled with the buckling groove. The bottom end of the inner sliding sleeve is buckled with the lower connecting plate; the outer cover shell is connected with the lower connecting plate with a screw. In this structure, the through hole is formed in the side wall of the bottom end of the outer sliding sleeve.

2. The locking device can be of other structure, such as a knob device, the screw rod on the rotary knob penetrates the through hole of the outer sliding sleeve to abut against the side wall of the inner sliding sleeve to realize the locking purpose of the inner sliding sleeve and the outer sliding sleeve.

Or a sliding block structure with an inclined surface is arranged between the inner sliding sleeve and the outer sliding sleeve, a first sliding block with an inclined surface is fixedly arranged on the outer wall of the side wall of the inner sliding sleeve, a screw sleeve is fixed on the side wall of the outer sliding sleeve, and the screw rod is in threaded connection within the screw sleeve, one end of the screw rod is rotationally connected with a second sliding block with an inclined surface. When the inner sliding sleeve is separated from the outer sliding sleeve, by screwing the screw rod outward, the second sliding block moves outwards so that the second sliding block and the first sliding block are separated, and a sliding adjustment is carried out between the inner sliding sleeve and the outer sliding sleeve; when the adjustment reaches to a proper position, by screwing the screw rod inwards to enable the second sliding block to move inward, and the inner sliding sleeve and the outer sliding sleeve are locked through the inclined surfaces of the two sliding blocks.

We claim:

1. A lifting platform with a sliding keyboard holder, comprising a table plate (1) and a base (3), a supporting leg (2) to connect table plate (1) with base (3), a keyboard holder (4) connected to the table plate (1), the base (3) is placed on a working table surface (99), wherein the keyboard holder (4) is slidably connected to the table plate (1) in the vertical direction and is locked by a locking device, the moving route of the keyboard holder (4) in the vertical direction is from the position below the working table surface to the position above the working table surface;

wherein the keyboard holder (4) is connected with the table plate (1) through a sliding structure, and the sliding structure is of a sleeve structure, the table plate (1) is connected to the upper end of the sleeve structure, and the keyboard holder (4) is connected to the lower end of the sleeve structure;

wherein the sleeve structure comprises an upper connecting plate (5), an inner sliding sleeve (6), an outer sliding sleeve (7), an outer cover shell (8) and a lower connecting plate (9), the upper connecting plate (5) is of L-shape, one side of the L-shape is fixedly connected with the table plate (1), the other side of the L-shape is fixedly connected with the inner sliding sleeve (6); the inner sliding sleeve (6) is in sliding connection with the outer sliding sleeve (7), the outer sliding sleeve (7) is fixedly connected with the outer cover shell (8); the lower connecting plate (9) is horizontally arranged and connected to the lower end of the outer cover shell (8); the keyboard holder (4) is fixedly connected to the lower connecting plate (9).

2. The lifting platform with a sliding keyboard holder of claim 1, wherein the outer sliding sleeve (7), the outer cover shell (8) and the lower connecting plate (9) are connected together; a threaded hole (18) is formed in the edge of the outer cover shell (8), the lower connecting plate (9) is connected to the threaded hole (18) of the outer cover shell (8) from bottom to top through a screw, the lower connecting plate (9) is provided with a buckling groove (14), and the bottom end of the outer sliding sleeve (7) is provided with a buckle (15) which is buckled with the buckling groove (14).

3. The lifting platform with a sliding keyboard holder of claim 1, wherein the locking device is installed on the outer cover shell (8); a through hole (16) is formed in the side wall of the outer sliding sleeve (7) corresponding to the locking device;

a locking block (13) penetrates the through hole (16) and is tightly pressed on the side wall of the inner sliding sleeve (6) when locking.

4. The lifting platform with a sliding keyboard holder of claim 1, wherein the locking device further comprises a handle (10), a handle support (11) and a pressing cap (12); the handle support (11) is fixedly connected to the side wall of the outer cover shell (8); the handle (10) is hinged to the handle support (11), and a small through hole (17) is formed in the bottom surface of the handle support (11); the pressing cap (12) comprises a plate-shaped cap edge and a cap barrel with a bottom, the cap edge is located on the inner side of the side wall of the outer cover shell (8), and the cap barrel penetrates the side wall of the outer cover shell (8) and the small through hole (17) of the handle support (11) and is tightly pressed with the handle (10); the shape of the locking block (13) is a cap with a cap edge matched with the shape of the pressing cap (12); the cap barrel of the locking block (13) is fastened in the cap barrel of the pressing cap (12); the cap edge of the locking block (13) is clamped with the cap edge of the pressing cap (12); the end surface of the cap edge of the locking block (13) is located outside the end surface of the cap edge of the pressing cap (12); when locking, the end surface of the locking block (13) is abutted against the side wall of the inner sliding sleeve (6); the planes of rotation of the handle (10) comprise a flat surface and an arc surface, the distance between the flat surface to the rotating center of the handle (10) is further than the distance from the arc surface to the rotating center of the handle (10), the flat surface of the handle (10) is propped against the cap barrel when locking;

and the arc surface of the handle (10) is in contact with the cap barrel when loosened.

* * * * *